US010111538B2

(12) United States Patent
Weiss

(10) Patent No.: US 10,111,538 B2
(45) Date of Patent: Oct. 30, 2018

(54) PRODUCT DISPLAY UNIT

(71) Applicant: PAN-DUR Holding GmbH & Co. KG, Ravenstein (DE)

(72) Inventor: Albert Weiss, Osterburken (DE)

(73) Assignee: PAN-DUR HOLDING GMBH & CO. KG, Ravenstein (DE)

( * ) Notice: Subject to any disclaimer, the term of this patent is extended or adjusted under 35 U.S.C. 154(b) by 0 days.

(21) Appl. No.: 15/375,662

(22) Filed: Dec. 12, 2016

(65) Prior Publication Data

US 2017/0164763 A1 Jun. 15, 2017

(30) Foreign Application Priority Data

Dec. 11, 2015 (DE) ..... 10 2015 121 647

(51) Int. Cl.

| | |
|---|---|
| ***A47F 3/04*** | (2006.01) |
| ***F25D 11/00*** | (2006.01) |
| ***A47F 7/00*** | (2006.01) |
| ***E05D 15/26*** | (2006.01) |
| ***E05D 15/48*** | (2006.01) |
| ***E05F 17/00*** | (2006.01) |
| ***E05D 15/58*** | (2006.01) |

(52) U.S. Cl.

CPC ..... *A47F 3/0434* (2013.01); *A47F 3/043* (2013.01); *A47F 7/0071* (2013.01); *E05D 15/264* (2013.01); *E05D 15/48* (2013.01); *E05D 15/58* (2013.01); *E05F 17/004* (2013.01); *E05D 2015/485* (2013.01); *E05Y 2201/62* (2013.01)

(58) Field of Classification Search

CPC .... A47F 3/0434; A47F 7/0071; E05D 15/264; E05D 15/48; E05D 2015/485; E05F 17/004

USPC ..... 312/116

See application file for complete search history.

(56) References Cited

U.S. PATENT DOCUMENTS

| | | | | |
|---|---|---|---|---|
| 399,752 | A * | 3/1889 | Horrocks | |
| 3,318,047 | A * | 5/1967 | Carson | E06L 33/50 49/141 |
| 3,508,361 | A * | 4/1970 | Ryder | A47F 3/043 219/214 |
| 3,654,732 | A * | 4/1972 | Schacht | E05D 15/58 49/127 |

(Continued)

FOREIGN PATENT DOCUMENTS

| | | |
|---|---|---|
| DE | 202005015130 | 1/2006 |
| DE | 102010047039 | 4/2012 |

(Continued)

OTHER PUBLICATIONS

EP Patent Office Search Report, dated Apr. 11, 2017.
German Patent Office Search Report, dated Sep. 27, 2016.

*Primary Examiner* — Daniel J Troy
*Assistant Examiner* — Timothy M Ayres
(74) *Attorney, Agent, or Firm* — Dority & Manning, P.A.

(57) ABSTRACT

A product display unit serves the purpose of the accommodation and presentation of products, which can include foodstuffs to be cooled. The product display unit includes a receiving space for products, a plurality of doors, which are mounted in a pivoting manner around a swivel axis between an open position and a closed position. At least a part of the doors is also mounted in a displaceable manner along a guide assembly.

23 Claims, 10 Drawing Sheets

(56) References Cited

U.S. PATENT DOCUMENTS 3,722,964 A * 3/1973 Chitester ..... A47B 88/493 312/331
3,724,129 A * 4/1973 Stromquist ..... A47F 3/043 219/218
3,810,330 A * 5/1974 Daggy ..... E05D 15/58 49/127
4,224,975 A * 9/1980 Uehara ..... E05D 15/264 160/206
4,370,932 A * 2/1983 Etcheparre ..... B66C 11/16 104/173.1
4,416,086 A * 11/1983 Niekrasz ..... E05D 7/04 49/388
5,749,172 A * 5/1998 Isopahkala ..... E05D 15/0604 49/124
6,128,911 A * 10/2000 Mathews ..... A47F 3/0408 62/256
6,834,703 B2 * 12/2004 Pacholke ..... E05D 3/022 160/206
7,451,802 B2 * 11/2008 Cianciolo ..... E05D 15/08 160/210
8,627,604 B2 * 1/2014 Seymour ..... E05D 15/58 49/125
8,756,865 B2 * 6/2014 Nicholson ..... E05D 15/48 49/142
8,806,807 B2 * 8/2014 Rees ..... E05D 15/48 49/130
9,032,667 B2 * 5/2015 Artwohl ..... F25D 23/02 49/162
9,487,985 B2 * 11/2016 Conley ..... E06B 3/924
2008/0060274 A1 * 3/2008 Vooght ..... E05D 15/264 49/394
2008/0211359 A1 * 9/2008 Borgstrom ..... A47F 3/043 312/116
2010/0097780 A1 * 4/2010 Beatenbough ..... A47F 3/001 362/92
2012/0073205 A1 * 3/2012 Hamaker ..... E06B 3/5072 49/163
2016/0153705 A1 * 6/2016 Dubuc ..... A47F 3/0404 312/405.1

FOREIGN PATENT DOCUMENTS

DE 102014004351 B3 4/2015
EP 1394349 A1 3/2004
EP 1728954 12/2006
EP 2482015 A2 8/2012
EP 2907951 A1 8/2015

* cited by examiner

PRODUCT DISPLAY UNIT

FIELD OF THE INVENTION

The present invention relates to a product display unit, in particular in the form of a refrigerator, which serves the purpose of the accommodation and presentation of products to be cooled, preferably foodstuffs, whereas the product display unit includes a receiving space for products, and whereas the product display unit includes a multiple number of doors, which are mounted in a pivoting manner around a swivel axis between an open position and a closed position.

BACKGROUND OF THE INVENTION

Product display units conforming to this type are known in the state of the art and are used, for example in supermarkets, in order to present the products for sale to the customer.

SUMMARY OF THE INVENTION

The task of the invention is to further develop the product display unit presented in the state of the art.

The task is solved by a product display unit with the features described below.

The product display unit includes several transparent doors (for example, glass doors, which can be single-glazed or multi-glazed), which are preferably formed without a frame. Preferably, the doors feature a multiple glazing. Furthermore, each of the doors can be pivoted around a swivel axis, preferably vertically running, between an open position and a closed position, whereas, in the closed position, the doors close the receiving space towards the outside. If, on the other hand, one or more doors are located in their open position, the corresponding door permits access into the receiving space, such that products can be removed from the product display unit or put into it.

Furthermore, the invention now provides that at least a part of the doors is also mounted in a displaceable manner along a guide assembly (that is, adjacent to the specified pivoting capacity). Thus, the corresponding doors can be pivoted around a swivel axis and additionally displaced, preferably along a linear guide path. At this, the doors mounted in a displaceable manner can be displaced into a direction that runs parallel to the surface that is formed by the doors if they are in their closed position.

Preferably, the guide assembly comprises a guide arranged above and below the doors, such that the doors are guided in the area of their front sides or by means of bearing bolts or pivot bearings arranged in the area of the front sides.

Preferably, the doors mounted in a displaceable manner can be displaced into the specified direction by an amount that is between 1.5 times and 2.5 times the width of one of the doors mounted in a displaceable manner (whereas the width represents the maximum horizontal spatial extent of a door).

In particular, it is advantageous if each of the doors mounted in a displaceable manner is connected to one upper guide carriage and one lower guide carriage. The guide carriages are in contact with the guide assembly, are displaceable relative thereto and ultimately serve the purpose of supporting the doors mounted in a displaceable manner against the guide assembly. Thus, the doors mounted in a displaceable manner are displaceable, together with the guide carriages connected to them, along the guide assembly.

Preferably, the guide carriages are in direct contact with the guide assembly. In addition, the guide carriages can feature one or more, in particular ball-bearing, running rollers, through which they are in contact with the guide assembly. The running rollers can feature a rotational axis that runs vertically, horizontally or at an angle to the horizontal line and/or vertical line. Moreover, the guide carriages can also have a plurality of running rollers with differently oriented rotary axes.

It is also advantageous if each of the guide carriages is guided with the assistance of a guide rail of the guide assembly and is in this case movable relative to it. For example, the product display unit can feature an upper and a lower guide rail, whereas, one or more upper guide carriages is guided in the upper guide rail, and whereas one or more lower guide carriages is guided in the lower guide rail. The guide carriages are guided in, on and/or at the respective guide rails, preferably through the aforementioned running rollers.

It is also advantageous if the product display unit features retaining elements, with the assistance of which the doors mounted in a displaceable manner can be fixed in an operating position. At this, the operating position is the position of the respective door in which it is located when the product display unit is used as intended, in which all doors, after taking their closed position, are arranged side by side in a front view of the product display unit without mutual overlapping, and close the receiving space towards the outside.

In particular, the individual guide carriages should be approximately the same horizontal distance to each other if all of the doors are located in their respective operating positions (provided that there are more than two upper and more than two lower guide carriages).

Preferably, the distance between two upper guide carriages and/or the distance between two lower guide carriages is 1.5 times to 2.5 times the aforementioned width of one of the doors mounted in a displaceable manner.

In any case, the retaining elements serve the purpose of fixing the respective door in its operating position. Preferably, a retaining element is allocated to each guide carriage, whereas the retaining element can be a part of the carriage. Alternatively, the retaining element can also be arranged on or in a guide rail or another stationary section of the product display unit. In any event, it is advantageous if the doors are fixed with the assistance of the retaining elements solely by a certain retaining force, which can be overcome by the fact that the respective door is pushed or pulled in the horizontal direction.

The force required to overcome the retaining force is measured in such a manner that the respective doors, on the one hand, can be reliably held in their operating position and, on the other hand, can be displaced counter to the retaining force by an operator without major physical exertion.

In particular, no locking device must be released prior to the displacement of the corresponding door out of its operating position, such that the displacement can be effected particularly rapidly and easily. Finally, the door can be displaced along the guide rails after overcoming the retaining force and finally assume a filling position. The filling position is defined as the position that the respective door occupies if, after overcoming the retaining force of the retaining element or elements allocated to it, the guide carriages that are connected to the door abut against a stop surface and are prevented from moving further because the stop surface blocks further displacement of the guide carriages. In this position, the product display unit can finally be filled with products with particular ease, since the access opening between two adjacent doors has been substantially enlarged by displacing at least one of the two doors into its filling position.

It is also advantageous if each retaining element is allocated to one of the guide carriages. In particular, it is advantageous if the retaining elements comprise a component of the guide carriages and are displaceable with them. It would also be conceivable to form the retaining elements as a part of the guide assembly or another stationary section of the product display unit, or to attach them to one of the specified areas.

In particular, it is provided that the respective retaining element fixes the guide carriage allocated to it and thus the door(s) connected to the guide carriage in the corresponding operating position by the fact that, during or after the taking of the operating position of the corresponding door, it engages in a recess. The recess is preferably arranged as a section of a component that is arranged on a frame section (or another stationary area) of the product display unit. Preferably, the component is fastened independent of the guide rails and spaced apart from it.

The retaining element can be formed, for example, as a bolt that is mounted in a movable manner between a holding position, in which it fixes the door allocated to it in its operating position, and a waiting position, in which it does not fix the door. Likewise, it is possible that the retaining element comprises a ball that is movable between the specified positions and that engages in the corresponding recess in the holding position. Preferably, by means of a force generating means, such as the spring element described below, the retaining element is preloaded in any position; that is, it is exposed to a certain compressive or tensile force.

Furthermore, it is advantageous if each of the retaining elements is a part of a guide carriage, and each of the recesses is a part of the guide assembly or of another rigid section of the product display unit. In this case, the respective retaining element can be displaced, together with the guide carriage, until it engages in one of the recesses and thereby fixes the door allocated to the retaining element in its operating position. It would also be possible to arrange the retaining elements in a stationary manner and to provide the respective guide carriages with the specified recesses, such that the retaining elements engage in the recesses, after or while they have been or will be displaced into the area of the retaining elements.

It is also advantageous if each of the retaining elements is subjected to a retaining force with the assistance of spring elements, which effect a fixing of the doors mounted in a displaceable manner in their respective filling position. The spring elements preferably comprise compression springs, whereas such elements can be held by means of guides. In any event, the spring elements bring about the fact that the retaining elements are pressed in the direction of and ultimately into the aforementioned recesses as soon as the respective doors have been moved out of the filling position into the corresponding operating position. Preferably, a spring element is allocated to each retaining element.

If the respective door is finally pushed out of its operating position in the direction of the filling position, the retaining element is pushed out of the recess and thus releases the corresponding door, without additional securing devices having to be released in this connection. After overcoming the retaining force, the corresponding door can finally be displaced into its operating position, whereas, in this case, only the frictional force between the guide carriages connected to the door and the guide assembly guiding the guide carriages must be overcome.

Thus, it is particularly advantageous if, during the displacement of the doors from their operating position into their filling position, only the retaining force generated by the spring elements must be overcome. Thus, in order to move the respective doors from their operating position, no securing device, such as a locking device, must be released, such that the doors can be moved particularly easily and rapidly. Preferably, the doors are not fixed in their filling position. Alternatively, the product display unit can also feature retaining elements, with the assistance of which the doors are fixed in their filling position, whereas such elements can feature the same characteristics as the previously described retaining elements. In particular, the retaining elements that fix the doors mounted in a displaceable manner in their operating position may comprise the retaining elements that fix the specified doors in their filling position (for example, if the retaining elements are a part of the guide carriage).

Furthermore, the product display unit can also feature retaining elements, with the assistance of which the doors are held in their operating position and/or filling position by means of magnetic force.

In any event, it is decisive that the doors can be moved from the respective position by which they are fixed by one or more retaining elements, without any securing device or locking device being released beforehand. Rather, it is sufficient to move the door in the horizontal direction with a certain force, since the fixing is thereby released without further action.

In principle, the product display unit can also feature different types of retaining elements, whereas only one type of retaining element, or even several different types of retaining elements, can be allocated simultaneously to each door.

Preferably, the retaining force of the respective retaining element is adjustable, in order to ensure a secure fixing of the doors mounted in a displaceable manner in their operating and/or filling position and, on the other hand, a release of the fixing by displacing the corresponding door.

It is also advantageous if each of the lower guide carriage and the upper guide carriage that is connected to the same door are connected with the assistance of one or more guide ropes. In particular, with both of its ends, each of the guide ropes should be fixed to a rigid (that is, stationary) carrier or section of the product display unit.

The respective guide ropes run in a front view of the product display unit, preferably in a symmetrically identical manner to a vertically running mirror axis and/or in a symmetrically identical manner to a horizontally running mirror axis. Preferably, the guide ropes comprise wire ropes. In either case, a first guide rope is connected to the upper guide carriage of a door mounted in a displaceable manner, and the second guide rope is connected to the lower guide carriage, such that both guide carriages can be displaced only simultaneously and in the same direction.

For this purpose, the guide carriages preferably feature deflecting rollers, whereas each deflecting roller is wrapped around a certain angular range by one of the guide ropes. Preferably, several upper and several lower guide carriages are connected to each guide rope, such that two guide ropes are sufficient to connect or guide two, four, six or even eight guide carriages in such a manner that an upper guide carriage can always only be moved simultaneously with the lower guide carriage arranged vertically underneath.

It is also advantageous if at least one upper guide carriage and one lower guide carriage are connected to two adjacent doors. Preferably, each of the two of the displaceable doors is connected through one lower guide carriage and one upper guide carriage arranged above it to form one unit, which can only be moved, as a whole, between an operating position and a filling position.

The two doors are preferably mounted in such a manner that they are arranged in a mirror-inverted manner relative to each other in relation to an axis running between the two doors in the vertical direction, provided that both have taken their closed position or their open position. In particular, the swivel axes or bearing bolts of both doors should be located on the side of the respective door turned towards the axis.

Thus, the door arranged in a front view on the right preferably can be pivoted around a swivel axis arranged in the left area of the door, while the door arranged on the left can be pivoted around a swivel axis arranged in the right area. Thus, preferably, the upper guide carriage and the lower guide carriage each have two pivot bearings, whereas, in each case, a first pivot bearing is connected to a first door and a second pivot bearing is connected to a second door. The pivot bearings preferably have a recess or a through hole into which bearing bolts of the specified doors engage and are thereby rotatably guided.

Of course, each or only a part of the lower guide carriages and/or each or only a part of the upper guide carriages can also be connected to only one door.

It is conceivable that each of the doors themselves comprises an upper pivot bearing and a lower pivot bearing, whereas each of the pivot bearings is connected to a guide carriage or a bearing bolt thereof. However, it is more advantageous if the swivel bearings are a part of the guide carriages and the bearing bolts that engage with them are fastened to the door. The bearing bolts are finally guided by the pivot bearings and can rotate in them around the respective swivel axis.

Furthermore, it is advantageous if the doors mounted in a displaceable manner are mounted in or on the upper guide carriages in such a manner that a relative movement between the respective door and the upper guide carriages connected to the door in the vertical direction is possible. In other words, it is advantageous if the doors are mounted in such a manner that a lowering of the upper guide carriages in the vertical direction by a certain area does not lead to a tilting of the doors that are connected to the corresponding guide carriages. A lowering can occur if the top area of the product display unit, as is preferred within the framework of the invention, is connected to the bottom area thereof exclusively through side walls and a rear wall, without the top area being supported by additional vertical support brackets in the front area of the product display unit (here, a specified cold deformation of the top area can occur).

If the doors now feature bearing bolts that project upwards into the guide carriages and that are mounted in a movable manner in the vertical direction in the pivot bearings of the guide carriages (so-called "floating bearings"), the bearing bolts and the guide carriage receiving them can move relative to each other in the vertical direction. Thus, within certain limits, the lowering of the top area has no influence on the pivoting capacity of the doors.

Thus, it is particularly advantageous if at least each of the doors mounted in a displaceable manner features an upwardly pointing bearing bolt, which projects in the vertical direction into a through hole or recess of an upper guide carriage that is connected to the corresponding door, and which, at least within certain limits, is guided in a freely movable manner in the vertical direction within the through hole or recess. In contrast to this, it is advantageous if the lower bearing bolts of the doors are also guided in or on guides of the lower guide carriages in the vertical direction and are thus supported.

Furthermore, it is advantageous if the bearing bolt features a stop and the upper guide carriage guiding the bearing bolt features a counter-stop. If the upper and lower guide carriages arranged underneath are guided in such a manner (for example, by the guide ropes described above) that an upper guide carriage and the lower guide carriages connected to the same door can only be displaced together and by the same distance, the tilting of the door need not be feared (whereas tilting is understood as a movement that has the consequence that the swivel axis of the corresponding door no longer runs vertically after tilting). In this case, the specified stop need not be in contact with the counter-stop in order to avoid friction losses during the pivoting of the door between its open and closed position.

If, on the other hand, the door is tilted since, for example, one of the guide ropes has torn off, has sprung from one of its guides or has detached itself from its fixing, the stop comes into contact with the counter-stop and thereby prevents the further tilting of the door. Preferably, the stop is formed by a bead or a projection of the upper bearing bolt. It would also be conceivable that the stop is formed by a securing ring that surrounds the bearing bolt and is connected to the bearing bolt in a force-fitting or positive-locking manner.

The counter-stop is preferably arranged below the stop and is formed to be, for example, ring-shaped. Preferably, the distance between the stop and the counter-stop in the non-tilted state of the corresponding door amounts to between 2 mm and 30 mm.

It is also advantageous if the product display unit features, in a front view, at least one middle door, which is mounted both in a pivoting and displaceable manner. In addition, in the front view, each of the the product display units should feature one end-side door to the left of the middle door(s) and one end-side door to the right of the middle door(s), which are permanently fixed in a stationary manner, such that they cannot be displaced when the product display unit is used as intended. Of course, a plurality of the specified middle doors may also be arranged between the edge-side doors, the term "middle door" merely indicates that, in a front view of the product display unit, the door is adjoined by at least one door arranged to the right of it and at least one door arranged to the left of it.

Thus, in the areas adjacent to the two side walls, the product display unit preferably has a door that is mounted such that it is able solely to be pivoted, but not slid, whereas the door(s) arranged between them are able to be pivoted and are mounted in a displaceable manner.

In particular, in a front view, the product display unit should feature an end-side door arranged to the left, an end-side door arranged to the right and a multiple number of middle doors arranged in between, which are additionally mounted in a displaceable manner. Preferably, 2 times n middle doors are present, where n is a natural number between 1 and 10. Preferably, a pair of the middle doors is connected to one upper guide carriage and to one lower guide carriage, such that the number of guide carriages corresponds to the number of middle doors.

Likewise, it is advantageous if the product display unit features at least one movement stop that limits a movement of at least one displaceable door in a horizontal direction. The stop, for example, can be a part of a guide rail, or can project into the movement path of the respective guide carriage, in such a manner the guide carriage touches on the stop and thus prevents a further movement. This ensures that the guide carriage is stopped at a defined position.

In particular, the movement stop should be placed in such a manner that the guide carriage and thus the door(s) connected to the guide carriage are stopped at their operating position. In this case, the corresponding doors can be displaced from their filling position in the direction of their operating position and, after the stop caused by the movement stop, are finally fixed in their operating position by one or more retaining elements.

In addition, it is, of course, also conceivable for the product display unit to feature additional movement stops, which are arranged on a rigid (that is, fixed in a stationary manner) section (for example, the guide rails) of the product display unit, in such a manner that the middle doors are located in their filling position if they are in contact with the movement stops last specified.

In principle, it is also conceivable that individual or all movement stops include one or more magnets, with which the guide carriages come into contact if the doors that are connected to the guide carriages are located in their filling or operating position. Finally, the doors are fixed in the respective position by the magnets. Of course, in this case, the respective guide carriages should feature a magnetizable or magnetic stop surface, in order to be able to be fixed by the magnet.

Likewise, it would also be conceivable to equip the respective guide carriages with magnets that are in contact with a magnetic or magnetizable stop surface, as soon as the corresponding guide carriage is located in a position in which the doors that are connected to the guide carriage feature their operating or filling position.

In principle, it is also possible for the magnets alone to assume the function of the retaining elements described above. Alternatively, the magnets may be provided in addition to the retaining elements.

Preferably, each guide carriage is allocated with a corresponding movement stop, which brings the respective guide carriage to a stop at the position at which the door(s) connected to the guide carriage occupy/occupies its/their operating position.

In addition, it may also be advantageous if the product display unit features additional movement stops that stop the individual guide carriages at the points at which the doors, which are connected to the respective guide carriages, occupy their filling position. In this case, each of the the guide carriages can be displaced back and forth between two adjacent movement stops, such that the displacement of the doors into their respective positions can be effected easily and rapidly.

It is also advantageous if the product display unit features at least two movement stops, whereas a movement stop is arranged in the area of an upper guide rail and a second movement stop is arranged in the area of a lower guide rail.

The movement stops can be, for example, integrated into the guide rails or arranged next to such guide rails. Moreover, the movement stops can be present as separate components or be part of the guide rails.

More preferably, the product display unit features two upper guide carriages and two lower guide carriages, whereas each guide carriage is connected to two doors, which can be pivoted in their different pivoting directions between their open and closed positions.

Furthermore, the product display unit preferably features a first upper movement stop and a first lower movement stop for the first guide carriage and a second upper movement stop and a second lower movement stop for the second guide carriage. The first upper movement stop and the first lower movement stop are preferably arranged, in a front view of the product display unit, between the two guide carriages. Likewise, the second upper movement stop and the second lower movement stop are preferably arranged, in a front view of the product display unit, between the two guide carriages.

The two upper movement stops along with the two lower movement stops can be formed by one component. It is likewise conceivable for the individual movement stops to be formed by separate components.

Preferably, the distance between the two upper movement stops relative to each other and/or the distance between the two lower movement stops relative to each other amounts to 1.5 times to 2.5 times the width of a door.

Preferably, the respective movement stops are aligned in a mirror-inverted manner with respect to a horizontal mirror axis and/or a vertical mirror axis.

Furthermore, it is advantageous if the upper movement stops, in the front view of the product display unit, are arranged above the doors, and the lower movement stops are arranged below the doors, in order not to impair the view through the doors.

It is particularly advantageous if the product display unit features at least two middle doors that are mounted in a displaceable manner, between which one or more movement stops are arranged. In particular, the product display unit features two end-side doors and four middle doors, whereas the movement stops are located in the horizontal direction between the guide carriages of the two middle doors arranged to the right (in a front view of the product display unit) and the two middle doors arranged to the left (likewise in the front view of the product display unit).

Likewise, it is advantageous if a lighting device extends between a lower guide carriage and an upper guide carriage that is arranged in the vertical direction above the same, which is displaceable together with the lower guide carriage and the upper guide carriage.

The lighting device preferably includes one or more fluorescent tubes and/or LEDs. The lighting device is preferably in contact with one or more power rails, through which it receives the electrical energy necessary for lighting the product display unit. Likewise, the lighting device(s) can be connected to a cable that—for example, as a result of a spring force—is wound on a roller, if the doors move from their operating position into their filling position (or vice versa).

The lighting device is also preferably oriented in such a manner that it emits the greater part of the light emitted by it, directly or through corresponding reflectors, into the receiving space, and illuminates the products located therein.

In this connection, it is particularly advantageous if the lighting device is fastened to at least one of the guide carriages and is movable along the guide assembly with it. Preferably, each lighting device is connected to an upper guide carriage and a lower guide carriage arranged below it. Alternatively, the lighting devices can also be connected to or supported by the respective doors. It is also conceivable that a vertically running strut extends between a lower and an upper guide carriage, which strut is connected to the guide carriages and is a carrier of the lighting device.

While the product display unit described previously or in the following can be set up as a stand-alone arrangement, it is also conceivable to place a plurality of (that is, at least two) product display units directly next to each other, in order to multiply the overall receiving space of the arrangement that is thus obtained compared to one individual product display unit. In this case, the individual product display unit is to be preferably set up in such a manner that their doors, after assuming their respective closing positions, are located in one plane (provided that that all doors are located in their operating positions).

Preferably, the individual product display units are firmly connected to each other. In particular, a part or all of the product display units that are placed next to each other should have the same structure.

Preferably, each of the two product display units arranged adjacent to each other features a contact area (for example, in the form of the side walls turned towards each other), whereas each door, arranged adjacent to the contact area, of each product display unit is permanently fixed in a stationary manner in such a manner that it is not displaceable when the product display unit is used as intended. The same applies preferably to the doors that are located in the area of the two outer side walls of the arrangement formed by the product display unit.

BRIEF DESCRIPTION OF THE DRAWINGS

Further advantages of the invention are described in the following embodiments. This following is shown, in each case schematically.

DETAILED DESCRIPTION

It should be pointed out in advance that not all similar sections (for example, the guide carriages 6, 7 or bearing bolts 16) are provided with reference signs in all of the figures, in order to ensure better clarity.

Figure 1:
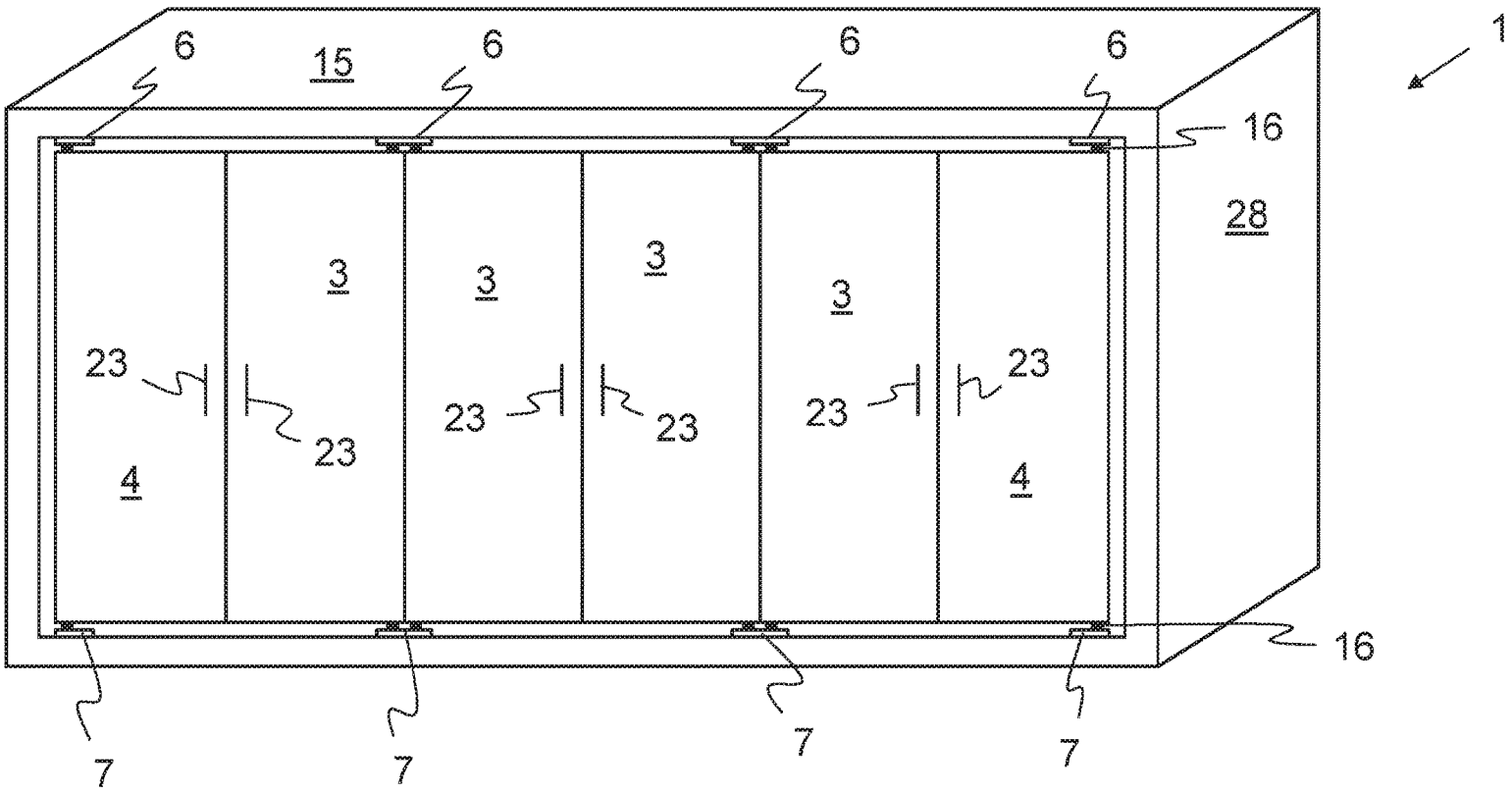
FIG. 1 a perspective view of a product display unit in accordance with the invention, the doors of which are in the closed position and in their respective operating positions, FIG. 2 the products display unit shown in FIG. 1, whereas the doors are in their open position, FIG. 3 the product display unit shown in FIG. 2, after the middle doors have been moved into their filling position, FIG. 4 a cut-out of a product display unit in accordance with the invention, FIG. 5 the cut-out shown in FIG. 4 with the changed position of the two right doors, FIG. 6 a cut-out of an additional product display unit in accordance with the invention, FIG. 7 a cut-out in the area of an upper guide carriage, FIG. 8 a cut-out in the area of an additional upper guide carriage, FIG. 9 the cut-out shown in FIG. 8 after the displacement of the guide carriage, and FIG. 10 a rear view of a cut-out of an additional product display unit in accordance with the invention.

FIG. 1 shows one embodiment of a product display unit 1 in accordance with the invention. In principle, the product display unit 1 includes a case that is defined by a top area 15, two side walls 28, a bottom area 25 not visible in FIG. 1 and a rear wall that connects the bottom area 25, the top area 15 and the side walls 28 and is likewise not visible.

Furthermore, the product display unit 1 includes a multiple number of doors 3, 4 mounted in a pivoting manner. Of course, the doors 3, 4 are formed to be transparent (this is not shown in the figures, in order to avoid presenting in detail the area behind the doors 3, 4; as this would have a negative effect on clarity).

In general, the product display unit 1 now always includes a left and a right edge-side door 4; that is, a door that is arranged directly adjacent to one of the two side walls 28. Furthermore, doors that are designated as middle doors 3 are arranged between the two edge-side doors 4.

Figure 2:
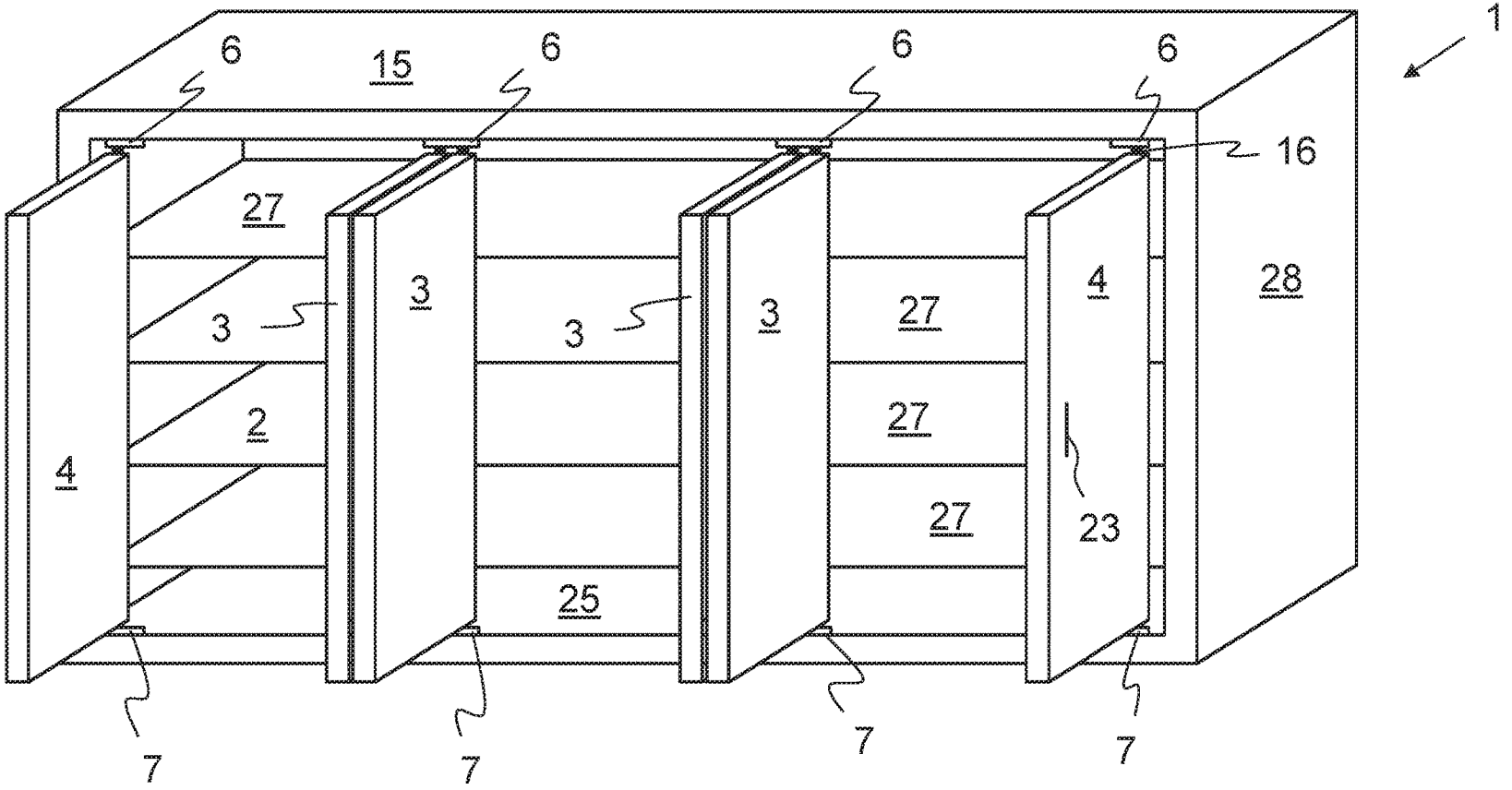

As can be seen from the comparison in FIGS. 1 and 2, the doors 3, 4 are now closed towards the outside between a closed position shown in FIG. 1, in which the receiving space 2 arranged behind the doors 3, 4 is closed to the outside for the products to be presented (for example, on shelves 27) and an open position shown in FIG. 2, in which the receiving space 2 is accessible from the outside, in order to be able to pivot around a swivel axis (for this purpose, the doors 3, 4 preferably feature corresponding handles 23).

Figure 3:
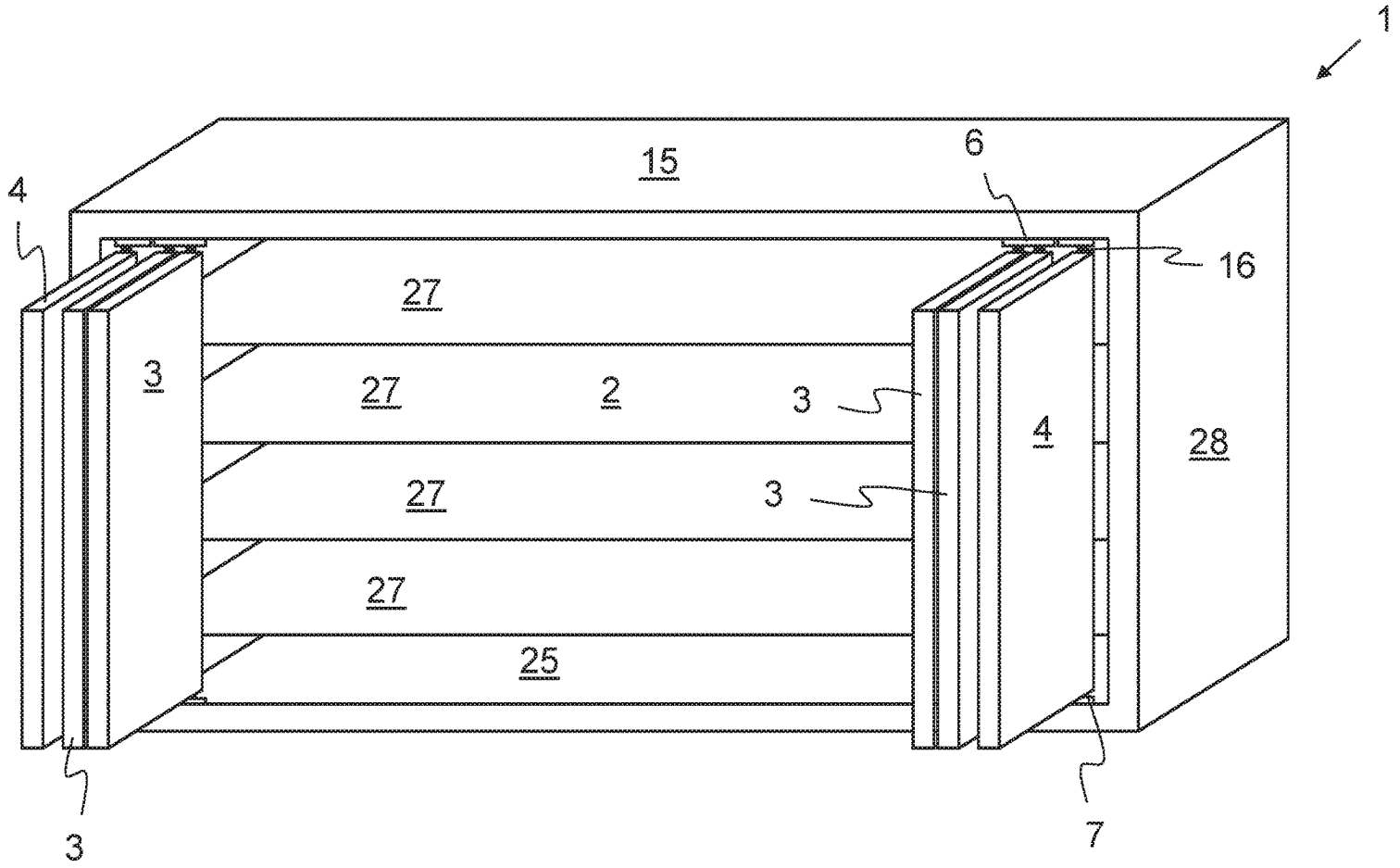

The comparison of FIGS. 2 and 3 also shows that, in addition to its pivoting capacity, the middle doors 3 can be displaced in the horizontal direction from an operating position (FIG. 2) into a filling position (FIG. 3). While the operating position corresponds to the position that the doors mounted in a displaceable manner 3 normally feature during public traffic, during which products are removed for purchase from the product display unit 1, the filling position primarily serves the purpose of the simple refilling of the previously sold products by staff.

In particular, it is advantageous in this connection if there are no load-bearing sections between the top area 15 and the bottom area 25 in the area between the side walls 28, such that almost the entire width of the receiving space 2 is accessible from the outside as soon as the middle doors 3 have taken their filling position.

Figure 4:
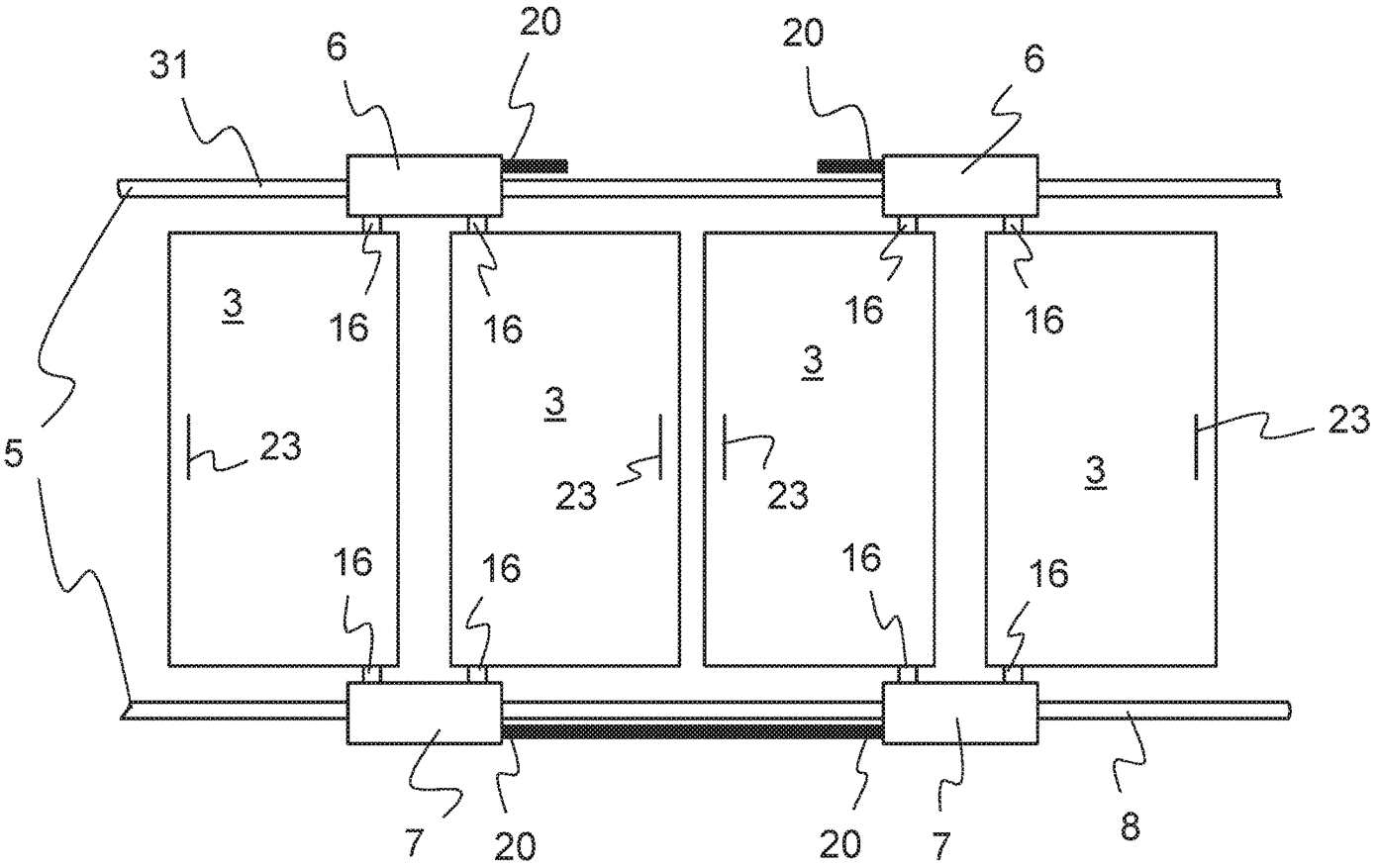
Figure 5:
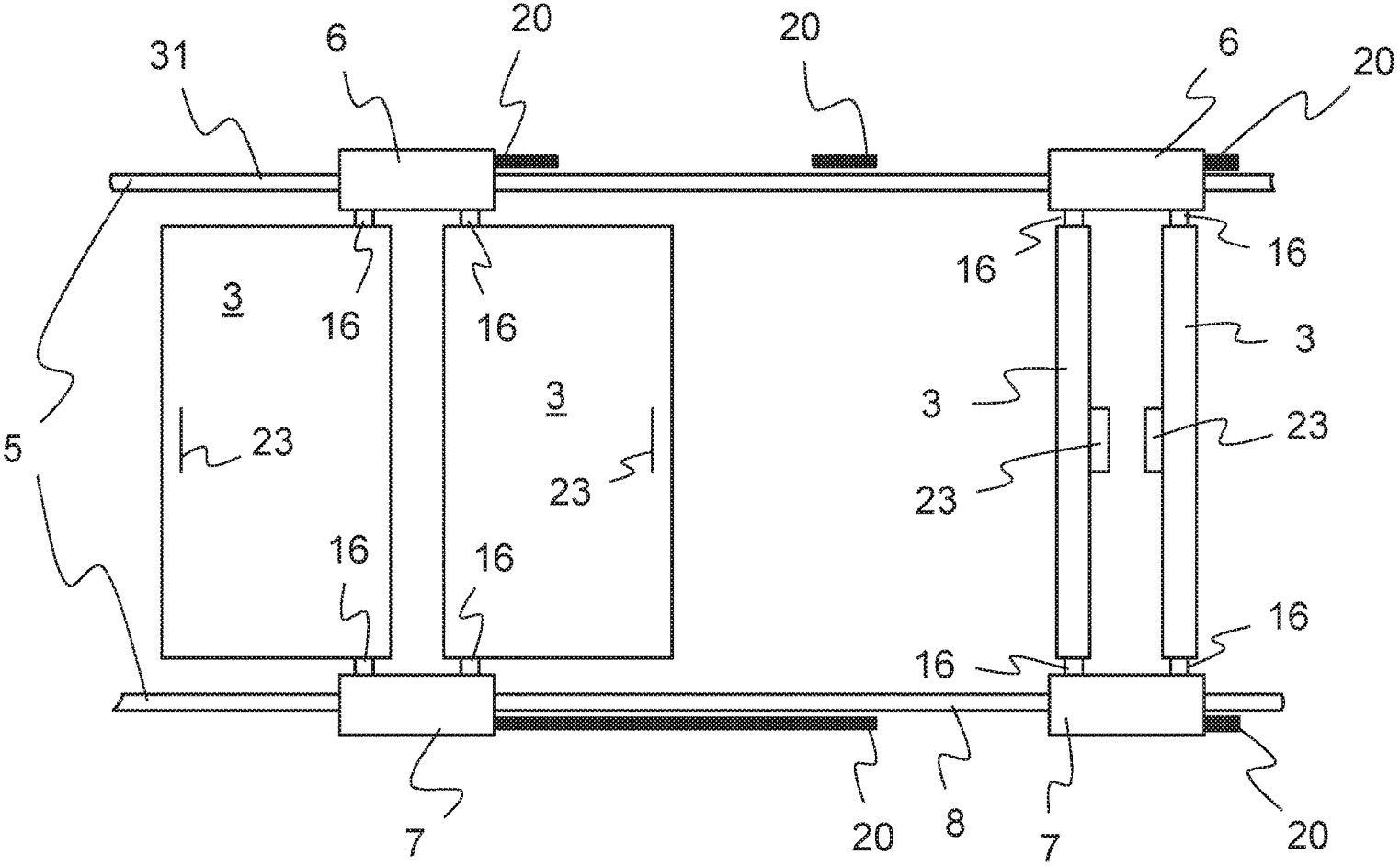

In order to enable a displacement of the middle doors 3, they are connected, for example by means of corresponding bearing bolts 16, with guide carriages 6, 7, which are guided in a movable manner by means of, among other things, a guide assembly 5 shown in FIGS. 4 and 5. The guide assembly 5 preferably comprises an upper guide rail 31 and a lower guide rail 8. The guide rails 8, 31 are preferably located behind a cover, such that they are not, or are only partially, visible in a front view of the product display unit 1.

In each case, the product display unit 1 comprises a multiple number of lower guide carriages 7, which are guided by the lower guide rail(s) 8 and a multiple number of upper guide carriages 6, which are guided by one or more upper guide rails 31. The mounting of the guide carriages 6, 7 are preferably mounted by means of running rollers, which engage in corresponding recesses of the guide rails 8, 31 or are surrounded by guide sections.

Preferably, each of the two middle doors 3 is connected to a common upper guide carriage 6 and a common lower guide carriage 7.

In order to be able to move the middle doors 3 from the filling position into the operating position in a simple manner, it is advantageous if movement stops 20 are allocated to the guide carriages 6, 7. The movement stops 20 are preferably located in the area of the upper guide rail 31 and/or the lower guide rail 8, but are preferably designed as separate components, which are fastened at corresponding fastening points of the product display unit 1 independent of the guide rails 8, 31.

As can be seen from the upper area of FIG. 4, the movement stops 20 can be formed by separate components. Likewise, a multiple number of movement stops 20 can be formed by a single component, as is shown, for example, in the lower area in FIG. 4.

Furthermore, it is conceivable that the product display unit 1 features only movement stops 20 that stop the middle doors 3 in their operating position (such movement stops 20 correspond to the movement stops 20 arranged, in accordance with FIG. 5, between the two lower guide carriages 7 and the two upper guide carriages 6). Of course, it may also be provided that the product display unit 1 features additional movement stops 20 that stop the lower guide carriages 7 and/or the upper guide carriages 6 in an area in which the middle doors 3 connected to the aforementioned guide carriages 6, 7 are located in their filling position (see the movement stops 20 arranged only in FIG. 5 on the right of the lower guide carriage 7 arranged on the right side and to the right of the upper guide carriage 6 arranged on the right side).

As already explained above, it is generally also conceivable to place the movement stops 20 within the guide rails 8, 31.

In addition, the respective guide carriages 6, 7 can generally feature sections that run within the respective guide rail 8, 31 and, for example, are covered by them upwards.

If the two middle doors 3 shown on the right in FIG. 5, which are located in their filling position, are displaced to the left, the lower guide carriage 7 and the upper guide carriage 6 would abut against the two movement stops 20 after a certain horizontal movement to the left, and would come to a stop. The position taken at this point in time finally corresponds to the operating position, such that no further adjustment of the position of the guide carriages 6, 7 or the middle doors 3 is necessary.

Figure 6:
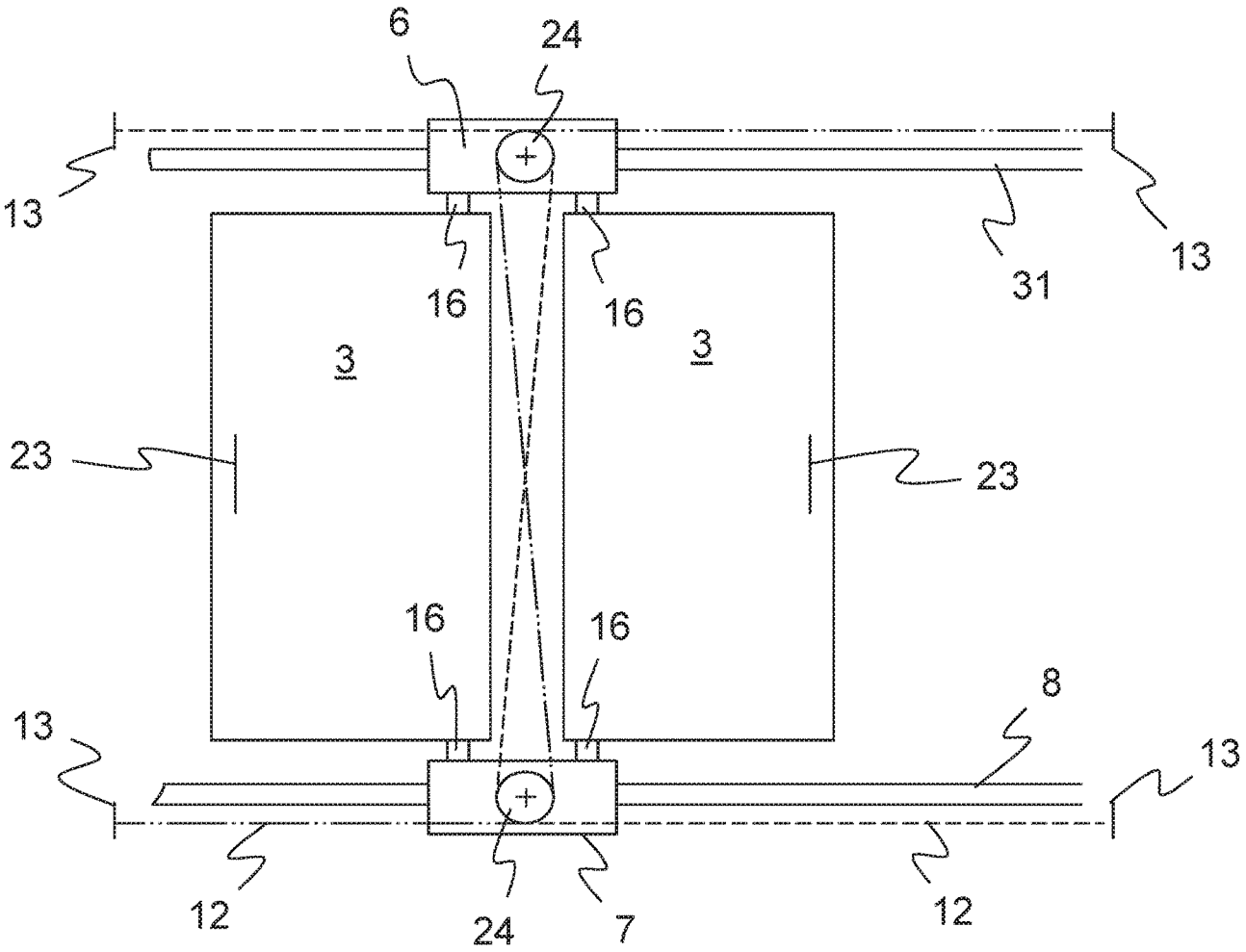

While upper and lower movement stops 20 are shown in FIGS. 5 and 6, in principle, it may also be sufficient to arrange corresponding movement stops 20 only in the area of the upper guide rail 31 or in the area of the lower guide rail 8.

In order to ensure that the guide carriages 6, 7 allocated to a door are always displaced simultaneously and at that at the same speed, an upper guide carriage 6 and a lower guide carriage 7 can be connected with the assistance of two guide ropes 12. Such a solution is shown in FIG. 6.

In this case, a first guide rope 12 runs from a carrier 13 of the product display unit 1 that is arranged in the left upper area of the upper area (this can, for example, comprise a frame section) through a deflecting roller 24 of the upper guide carriage 6. From there, it arrives at the deflecting roller 24 of the lower guide carriage 7, by which it is again deflected in the horizontal direction, in order to finally end in the area of a carrier 13 arranged at the lower right.

An additional guide rope 12 finally runs in a mirror-inverted manner to the first guide rope 12 from a carrier 13 to the right above the guide roller of the upper guide carriage 6, then over the guide roller of the lower guide carriage 7, and finally ends in the area of a carrier 13 arranged on the left. The carriers 13 may comprise arbitrarily stationary sections of the product display unit 1.

If the middle doors 3 connected to the two guide carriages 6, 7 are displaced in the horizontal direction, the guide ropes 12 ensure that both guide carriages 6, 7 can be displaced only simultaneously and equally rapidly. Thus, any tilting or tipping of the middle doors 3 is practically ruled out.

On the other hand, a tearing of one of the guide ropes 12 or another malfunction of the same may lead to the fact that the middle doors 3, which have been guided with the guide carriages 6, 7 guided by the guide ropes 12, can tilt around a horizontal tilting axis. Since the upper bearing bolt 16 is preferably mounted vertically in a movable manner in the upper guide carriage 6, in principle, there is the risk in this case that the middle doors 3 tilt to the extent that the bearing bolts 16 are no longer connected to the upper guide carriage 6. In this case, the middle doors 3 would completely fall out of the product display unit 1, such that a person standing in front of the product display unit 1 could be injured.

Figure 7:
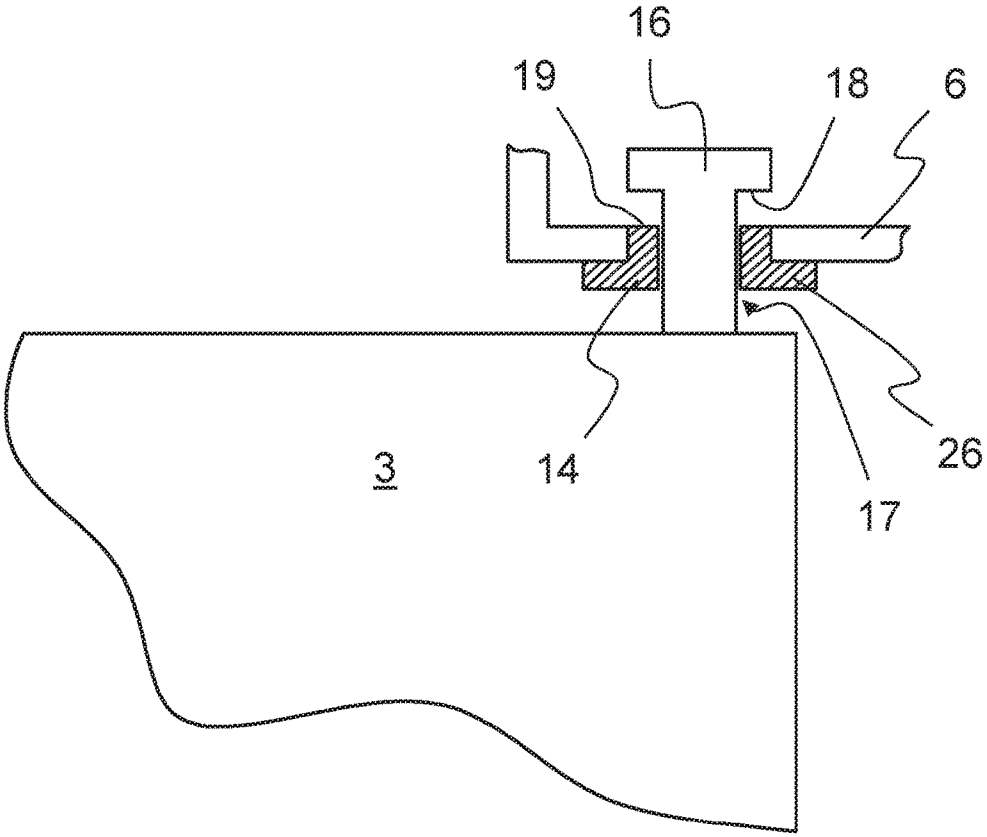

In order to prevent this, it can be advantageous to provide the bearing bolt 16 with a stop 18, as shown in FIG. 7. During assembly, the stop 18 is guided through an opening of the upper guide carriage 6. Subsequently, a sleeve 26 is pushed into the opening and is connected (for example, glued) to the upper guide carriage 6, whereas the sleeve 26 simultaneously forms a through hole 17 of the upper guide carriage 6 serving as the upper pivot bearing 14 of the bearing bolt 16.

If the middle door 3 shown in FIG. 7 begins to tilt, the stop 18 would shift downwards and finally come into contact with the counter-stop 19 formed by the sleeve 26. A further lowering of the upper bearing bolt 16 is thereby prevented, such that the middle door 3 is reliably held in its slightly tilted position. Thus, any danger to persons standing in front or any damage to the middle door 3 is avoided.

Of course, the described "falling protection" can also be solved in a different way. Preferably, however, a stop 18 and a counter-stop 19 are always present, whereas both of which come into contact with each other at a certain tilting angle. For example, the stop 18 could be formed by a securing ring (not shown), which surrounds the bearing bolt 16 above the sleeve 26 and abuts against this as soon as the bearing bolt 16 is lowered by tilting the middle door 3. In this case, the projection of the bearing bolt 16, which is shown in FIG. 7 and forms the stop 18, could be dispensed with.

Figure 8:
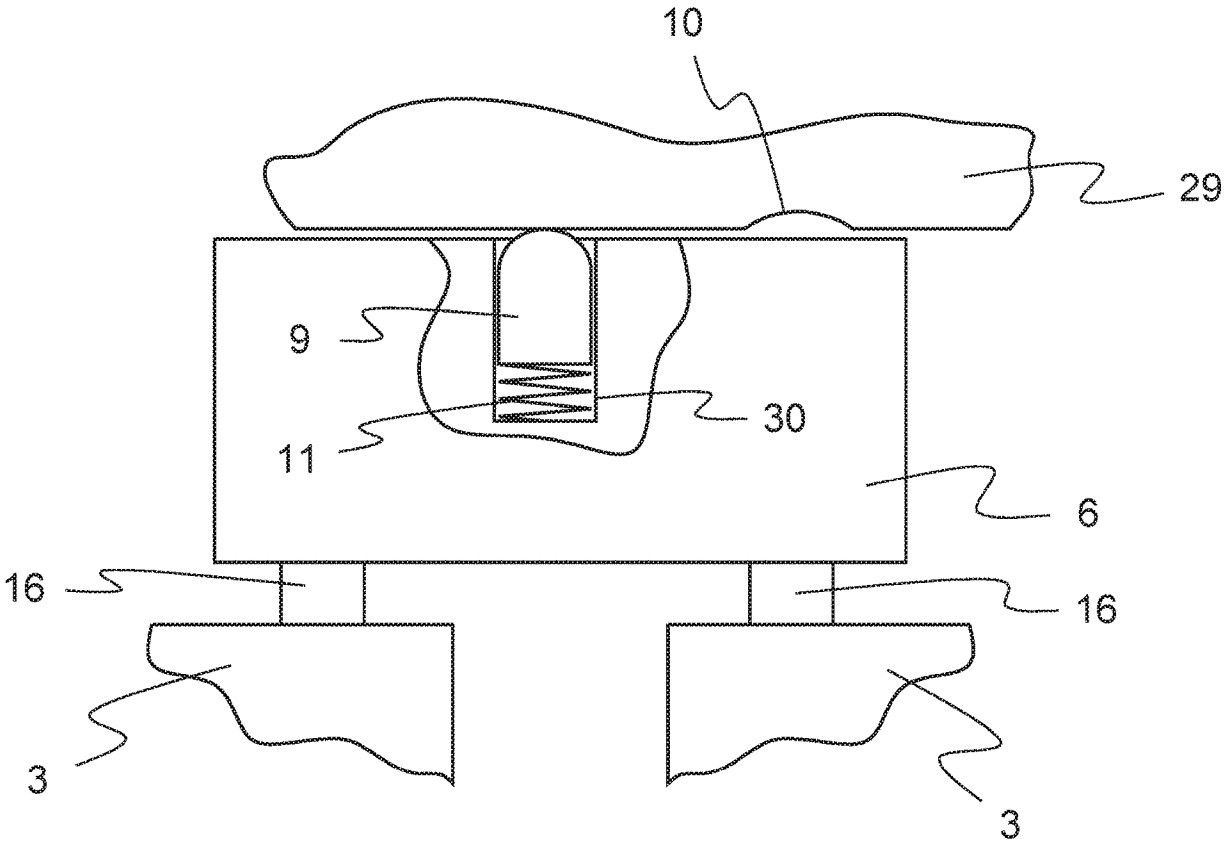
Figure 9:
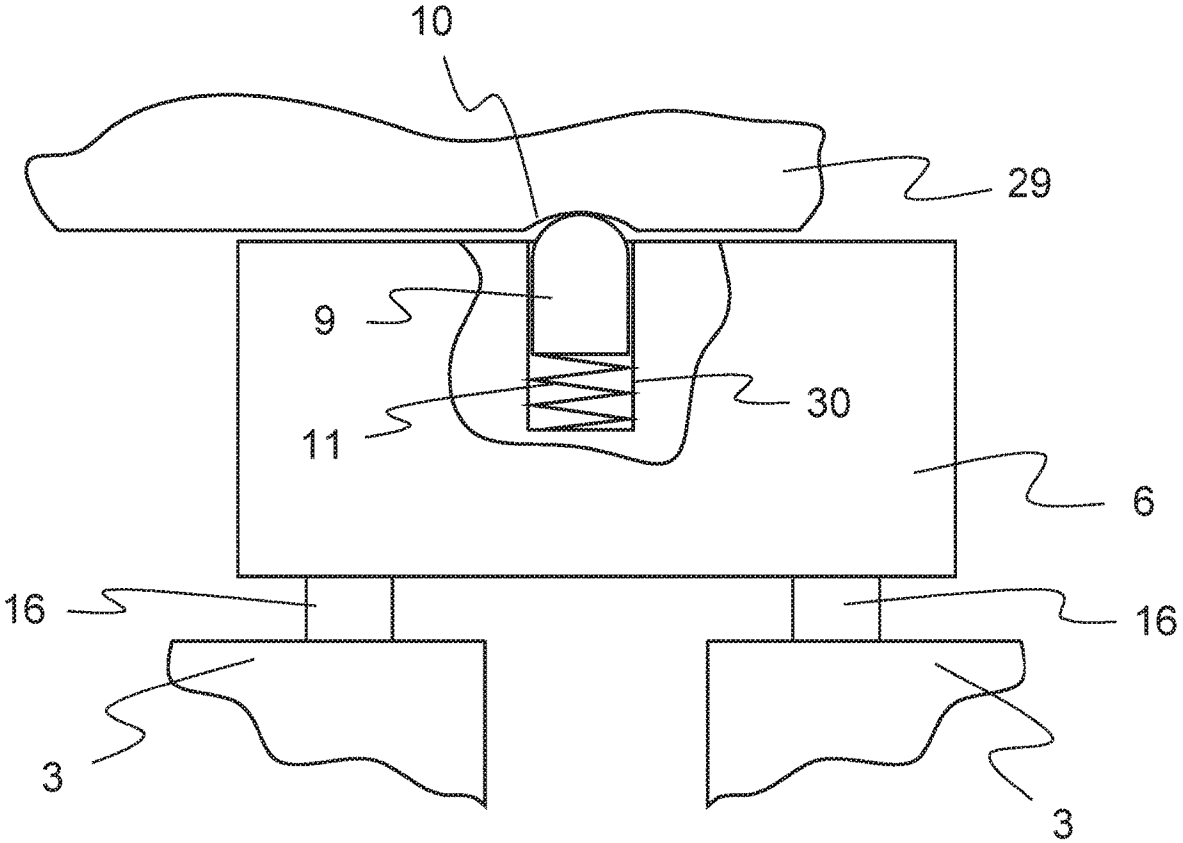

A particularly preferred solution, by means of which the guide carriages 6, 7 can be fixed in the position in which the middle doors 3 connected to them feature their operating position, are shown in FIGS. 8 and 9.

As FIGS. 8 and 9 show, the upper guide carriages 6 (and/or the lower guide carriages 7) can feature one or more detents that can be overcome by an external force applied by a human operator and can include retaining elements 9 that engage respective recesses 10 by a biasing force. Each of the retaining elements 9 is preferably guided in a receptacle 30 that is defined in a respective one of the guide carriages 6, 7 or rigid section 29 of the product display unit 1 and carried thereby. For each retaining element 9, a biasing element transmits a biasing force that presses one end of the respective retaining element 9 against one of the guide carriages 6, 7 or a rigid section 29 of the product display unit 1 by means of a spring element 11 disposed in the receptacle 30 against the opposite end of the retaining element 9. If the respective guide carriage 6, 7 now arrives in the area of a recess 10, which is preferably a part of a rigid section 29 of the product display unit 1, the retaining element 9 is pressed in the direction of the recess 10 through the biasing force of the spring element 11 (see FIGS. 8 and 9). The guide carriages 6, 7, and thus also the middle doors 3 that are connected to these guide carriages, are thereby fixed, preferably in their operating position.

In order to be able to displace the middle doors 3 back into their filling position, only the retaining force of the retaining elements 9 must be overcome in order to move the retaining elements 9 out of the corresponding recesses 10 and finally to transfer the guide carriages 6, 7 into the position shown in FIG. 8. The releasing of additional securing elements (such as, for example, a locking device) is not necessary.

Of course, in place of the pin-like retaining element 9, a retaining element 9 with a different shape, for example in the form of a ball, can also be used. Likewise, the respective retaining element 9 could be placed in a stationary position and the recess 10 could be a part of the guide carriage 6, 7.

All guide carriages 6, 7 preferably feature retaining elements 9 or recesses 10. Alternatively, it may also be sufficient to provide retaining elements 9 and recesses 10 exclusively in the upper or lower area of the product display unit 1.

Furthermore, it may be advantageous if the product display unit 1 features a plurality of lighting devices 21 that are fastened to the middle doors 3, to the guide carriages 6, 7 connected thereto, or to the struts 22 running vertically between the guide carriages 6, 7, in such a manner that they are horizontally displaceable with the middle doors 3.

Figure 10:
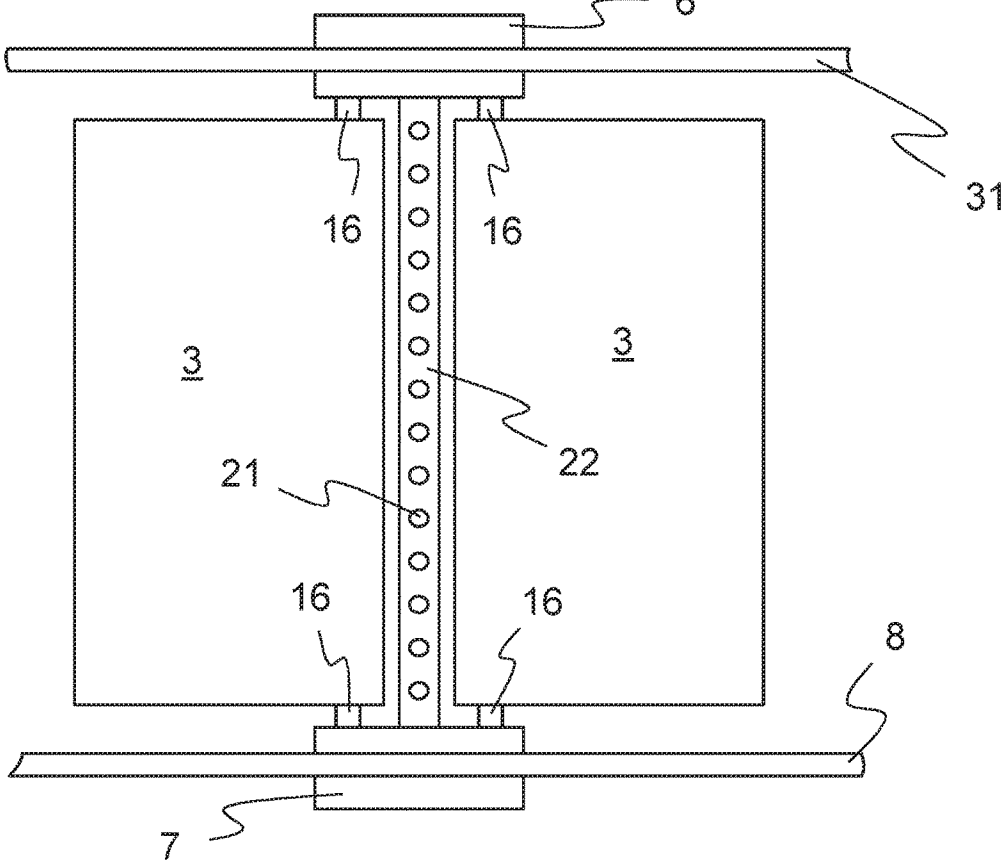

One embodiment of a lighting device 21 that is fastened to a strut 22 and includes several LEDs is shown in FIG. 10 (view from the receiving space 2 in the direction of the lighting device 21).

It would also be conceivable to integrate the lighting device 21, in particular several LEDs, into one or more vertically running edge areas of the middle doors 3.

In any case, the lighting device 21 should always run between a lower guide carriage 7 and an upper guide carriage 6, in order to be able to move with it.

This invention is not limited to the illustrated and described embodiments. Variations within the framework of the claims, such as any combination of the described characteristics, are also possible, even if they are presented and described in different parts of the description and/or the claims, or in different embodiments.

LIST OF REFERENCE SIGNS

1 Product display unit
2 Receiving space
3 Middle door
4 Edge-side door
5 Guide assembly
6 Upper guide carriage
7 Lower guide carriage
8 Lower guide rail
9 Retaining element
10 Recess
11 Spring element
12 Guide rope
13 Carrier
14 Upper pivot bearing
15 Top area
16 Bearing bolt
17 Through hole
18 Stop
19 Counter-stop
20 Movement stop
21 Lighting device
22 Strut
23 Handle
24 Deflecting roller
25 Bottom area
26 Sleeve
27 Shelve
28 Side wall
29 Rigid section of the product display unit
30 Receptacle
31 Upper guide rail

The invention claimed is:

1. Product display unit, which serves the purpose of the accommodation and presentation of products to be cooled, comprising:

a case defining a receiving space accessible via an opening defined by the case and through which the products can be transferred selectively into and selectively out of the receiving space;

a guide assembly connected to the case and including a lower guide rail elongating in a horizontal direction, the guide assembly including an upper guide rail elongating in a horizontal direction and spaced apart from the lower guide rail in a vertical direction that is perpendicular to the horizontal direction;

a first upper guide carriage is mounted in a manner so as to be displaceable in the horizontal direction along the upper guide rail;

a first lower guide carriage is mounted in a manner so as to be displaceable in the horizontal direction along the lower guide rail, the first lower guide carriage being configured to slidably engage the lower guide rail during displacement of the first lower guide carriage along the lower guide rail in the horizontal direction;

a plurality of doors, each door being pivotally mounted relative to the case so as to be pivotable around a swivel axis, which is defined by a respective bolt, which is carried by one of the case, the first upper guide carriage and the first lower guide carriage, each of the plurality of doors being so pivotally mounted around the swivel axis between a filling position permitting access to the receiving space via the opening in the case and an operating position denying access to the receiving space via the opening in the case; and a first detent including a retaining element fixing via a biasing force one of the first upper guide carriage and the first lower guide carriage to the case whereby a respective one of the plurality of doors mounted pivotably around the swivel axis of the respective bolt can be fixed in the operating position and whereby after the respective one of the plurality of doors is pivoted away from the operating position and toward the filling position then the respective one of the plurality of doors can be moved by manual movement alone to overcome the biasing force theretofore fixing the respective door in the operating position.

2. Product display unit according to claim 1, wherein the retaining element is part of the first upper guide carriage.

3. Product display unit according to claim 1, further comprising a first movement stop connected to the case and disposed so as to block horizontal displacement of the first upper guide carriage past the first movement stop along the upper guide rail.

4. Product display unit according to claim 3, further comprising a second movement stop, wherein the first movement stop is disposed in the area of the first upper guide rail and the second movement stop is disposed in the area of the first lower guide rail.

5. Product display unit according to claim 1, wherein the plurality of doors includes, in a front view, a middle door, which is mounted both in a pivoting and horizontally displaceable manner; a left end-side door disposed to the left of the middle door; a right end-side door disposed to the right of the middle door; wherein when assuming the closed position the middle door is not horizontally displaceable.

6. Product display unit according to claim 1, further comprising:

a lighting device;

wherein the first lower guide carriage and the first upper guide carriage are paired together such that the first upper guide carriage remains disposed vertically directly above the first lower guide carriage during displacement of the paired first lower guide carriage in the horizontal direction along the lower guide rail, and wherein the lighting device extends between the paired first lower and upper guide carriages.

7. Product display unit according to claim 6, wherein the lighting device is fastened to at least one of the paired first lower and upper guide carriages.

8. Product display unit according to claim 6, wherein a first one of the plurality of doors is connected to the paired first lower guide carriage and the first upper guide carriage and the lighting device is fastened to the first one of the plurality of doors.

9. Product display unit according to claim 6, further comprising a strut carried by the paired first lower and upper guide carriages, and wherein the lighting device is fastened to the strut.

10. Product display unit according to claim 1, wherein a first one of the plurality of doors is carried between the first upper guide carriage and the first lower guide carriage so as to be displaceable in the horizontal direction.

11. Product display unit according to claim 10, wherein the first upper guide carriage is connected to a first one of the plurality of doors, wherein the first upper guide carriage is connected to a second one of the plurality of doors, and wherein the first one of the plurality of doors is disposed adjacent the second one of the plurality of doors.

12. Product display unit according to claim 10, wherein the retaining element includes a spring element that exerts a retaining force, which is at least partly responsible for effecting a fixing of the first one of the plurality of doors mounted in a displaceable manner in its respective operating position.

13. Product display unit according to claim 12, wherein the retaining element is formed in such a manner that only the retaining force generated by the spring element must be overcome in order to effect the displacement of the first one of the plurality of doors from the operating position into the filling position.

14. Product display unit according to claim 10, wherein the first detent includes a recess configured to receive therein the retaining element so as to fix the first one of the plurality of doors in its operating position when the retaining element engages in the recess.

15. Product display unit according to claim 14, wherein the recess is defined in the case.

16. Product display unit according to claim 14, wherein the recess is a part of one of the first upper guide carriage and the first lower guide carriage, and the retaining element is a part of the case.

17. Product display unit according to claim 10, further comprising a pair of guide ropes connecting the first upper guide carriage with the first lower guide carriage.

18. Product display unit according to claim 17, further comprising:

a first carrier rigidly connected to the case;

a second carrier rigidly connected to the case;

wherein the pair of guide ropes includes a first guide rope having a first end and a second end opposite the first end, the first end of the first guide rope being fixed to the first carrier and the second end of the first guide rope being fixed to the second carrier; and wherein the pair of guide ropes includes a second guide rope having a first end and a second end opposite the first end, the first end of the second guide rope being fixed to the first carrier and the second end of the second guide rope being fixed to the second carrier.

19. Product display unit according to claim 10, wherein the first one of the plurality of doors is mounted in such a manner that the first one of the plurality of doors is displaceable in the vertical direction with respect to the upper guide rail during relative horizontal displacement of the first one of the plurality of doors relative to the upper guide rail.

20. Product display unit according to claim 10, wherein the first one of the plurality of doors includes a respective upper pivot bearing and a respective lower pivot bearing, wherein the upper pivot bearing is connected to the first upper guide carriage and the lower pivot bearing is connected to the first lower guide carriage.

21. Product display unit according to claim 10, wherein the first one of the plurality of doors includes an upwardly pointing bearing bolt, which projects in the vertical direction into a through hole of the first upper guide carriage and is guided in a freely movable manner in the vertical direction within the through hole.

22. Product display unit according to claim 10, further comprising:

a second upper guide carriage mounted in a manner so as to be displaceable in the horizontal direction along the upper guide rail;

a second lower guide carriage mounted in a manner so as to be displaceable in the horizontal direction along the lower guide rail, the second lower guide carriage being configured to slidably engage the lower guide rail during displacement of the second lower guide carriage along the lower guide rail in the horizontal direction;

a second one of the plurality of doors is carried between the second upper guide carriage and the second lower guide carriage so as to be displaceable in the horizontal direction; and a first movement stop disposed between the first one of the plurality of doors and the second one of the plurality of doors.

23. Product display unit according to claim 22, wherein the bearing bolt includes a stop and the first upper guide carriage guiding the bearing bolt includes a counter-stop, whereas, upon a tilting of the first one of the plurality of doors, the first movement stop comes into contact with the counter-stop and thereby prevents a further tilting of the first one of the plurality of doors.

* * * * *